US008844091B1

(12) United States Patent
Troyer

(10) Patent No.: US 8,844,091 B1
(45) Date of Patent: Sep. 30, 2014

(54) SPILL CLEANUP SYSTEM

(71) Applicant: Big T Holdings, LLC, Osceola, IN (US)

(72) Inventor: Lloyd Troyer, Osceola, IN (US)

(73) Assignee: Big T Holdings, LLC, Osceola, IN (US)

( * ) Notice: Subject to any disclaimer, the term of this patent is extended or adjusted under 35 U.S.C. 154(b) by 0 days.

(21) Appl. No.: 14/270,640

(22) Filed: May 6, 2014

(51) Int. Cl.
*A47L 13/51* (2006.01)
*A47L 13/52* (2006.01)
*A47L 13/50* (2006.01)
*A47L 13/11* (2006.01)

(52) U.S. Cl.
CPC *A47L 13/11* (2013.01); *A47L 13/50* (2013.01)
USPC ..... 15/257.1; 15/104.8; 15/245; 15/257.2

(58) Field of Classification Search
USPC ..... 15/104.8, 121, 257.1, 257.2, 245
See application file for complete search history.

(56) References Cited

U.S. PATENT DOCUMENTS 1,353,222 A * 9/1920 Dietzel ..... 15/104.8
3,639,937 A * 2/1972 Sweeney ..... 15/104.8

* cited by examiner

*Primary Examiner* — Randall Chin
(74) *Attorney, Agent, or Firm* — Botkin & Hall, LLP; Garrick T. Lankford

(57) ABSTRACT

A squeegee and tray system is provided to clean up spills. The tray has a front edge, a ramp, and a trough for receiving and transporting a spill. The squeegee has a resilient edge to push a spill into the front edge of the tray. A bracket is provided to mount on a vertical surface that receives the tray. The tray has a slot for receiving the squeegee where the squeegee and tray are stored together when placed on the mounting bracket.

19 Claims, 4 Drawing Sheets

SPILL CLEANUP SYSTEM

BACKGROUND OF THE INVENTION

This present disclosure relates to spill cleanup devices. Many dust pans and reservoirs exist on the market intended to assist the user in the efficient and thorough cleanup of spilled material. Most spill cleanup systems are a combination of a dust pan and a broom or squeegee. The dust pan and squeegee are usually intended to be stored and used together, but lack an adequate or efficient storage method. Losing of one of the parts is common, rendering the other parts useless or difficult to use. Some dust pans and brooms are snapped together in an attempt to solve this problem but lack a convenient method of storage. Frequently the user is left to set it somewhere or use a hole somewhere on the system that was originally intended for displaying it in the store. This is inconvenient, and frequently causes the user to toss it somewhere under a cabinet or a closet. Therefore, a good way to store the two together and out of the way is needed. The system described here solves the problems of cleaning up a spill and storing both together.

SUMMARY OF THE INVENTION

The present disclosure describes a spill cleanup system. The system has a squeegee, a tray, and a mounting bracket. The three parts come as a set. The mounting bracket is designed to be attached to a vertical surface, commonly the inside wall or door of a cabinet or closet. The tray has a ramp that serves as receiving surface for a spill and an interface with the mounting bracket. The bracket and the ramp have a similar angle, such that when the bracket is mounted to the wall, the tray can be placed onto the bracket, and both are held securely to the wall. The tray also has a slot designed to hold the squeegee up at an angle. This angle keeps the squeegee and the tray together as they are stored. The ramp is also a surface for pushing a spill into the tray. To use the system, the user takes the tray and squeegee from the storage position and uses the tray and squeegee to push the spill into the tray. The ramp and walls of the tray keep the spill contained while the user carries it to a trash bin or drain. When the user has emptied the tray, the squeegee is placed back in the slot and both are then placed onto the bracket, ready for the next spill. The system is designed to be mounted inside a cabinet in a space normally wasted, such as the space between the garbage disposal and the inside wall of a cabinet.

BRIEF DESCRIPTION OF THE DRAWINGS

A preferred embodiment of this invention has been chosen wherein.

DESCRIPTION OF THE PREFERRED EMBODIMENT

Figure 1:
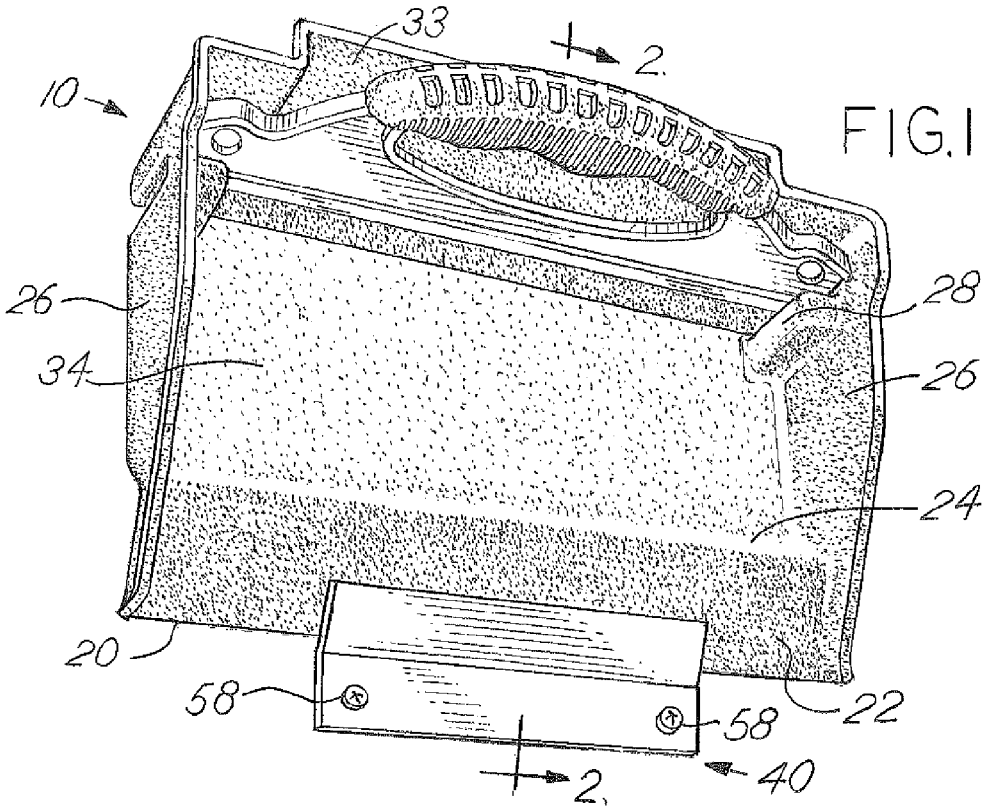
FIG. 1 is a perspective view of the tray as mounted and stored.
Figure 2:
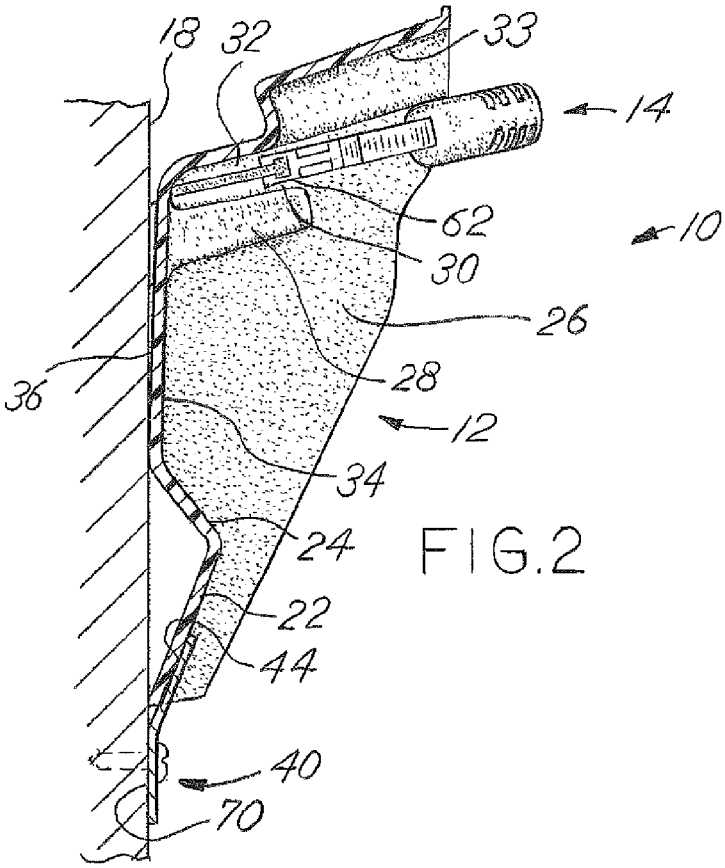
FIG. 2 is a section view 2-2 of the system as mounted and stored on a vertical surface.
Figure 3:
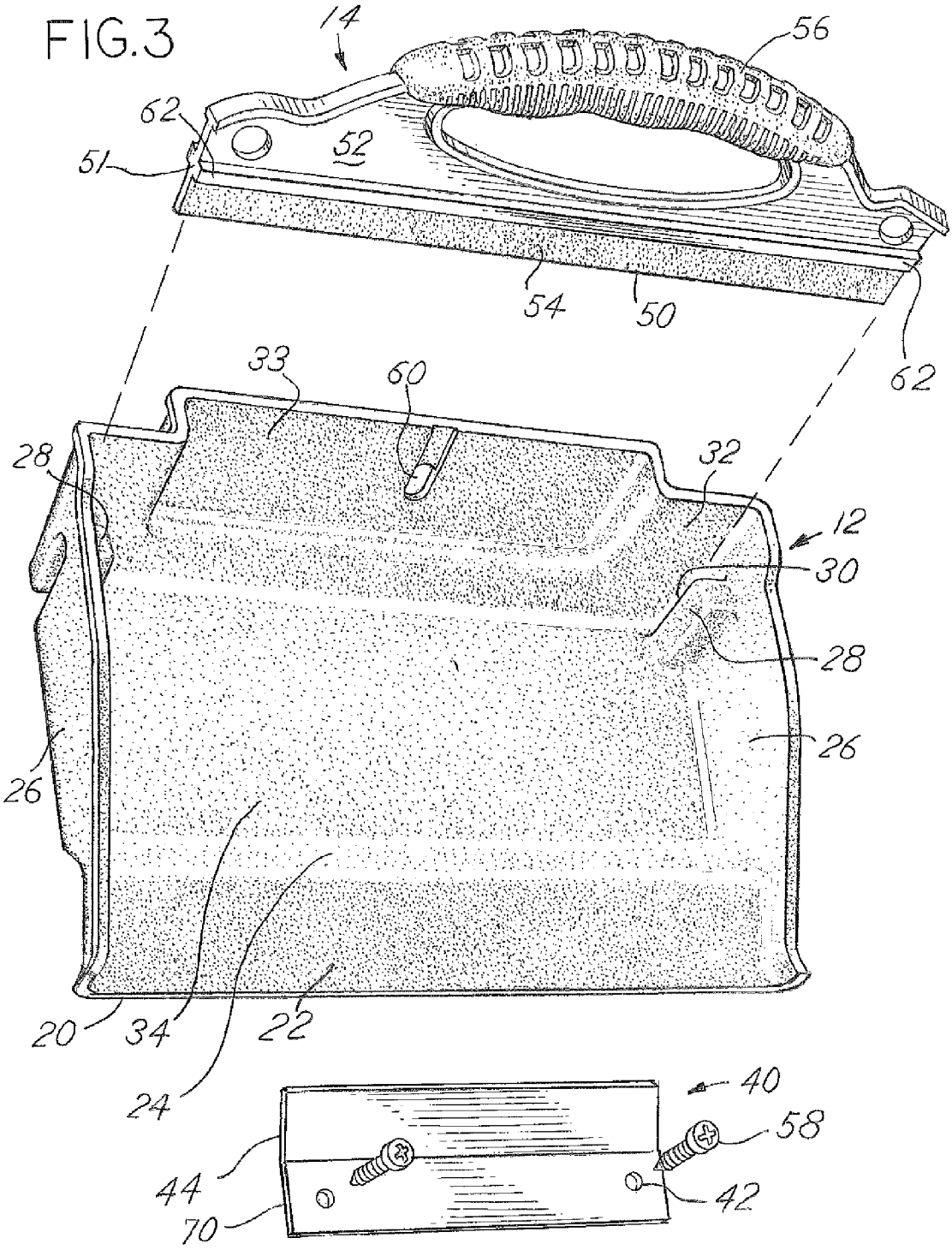
FIG. 3 is an exploded perspective view of the tray in FIG. 1.
Figure 6:
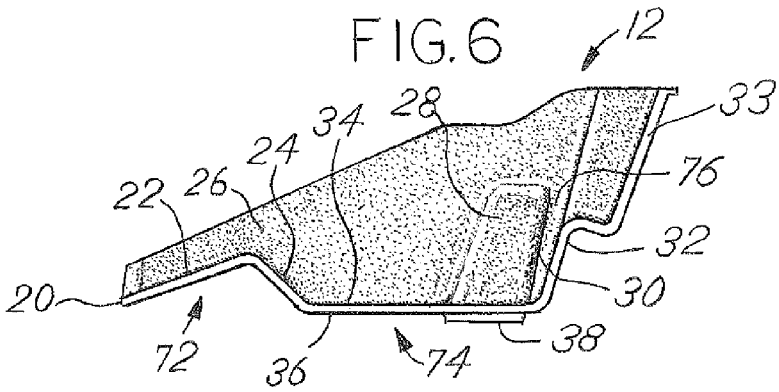
FIG. 6 is a side view of the tray.
Figure 7:
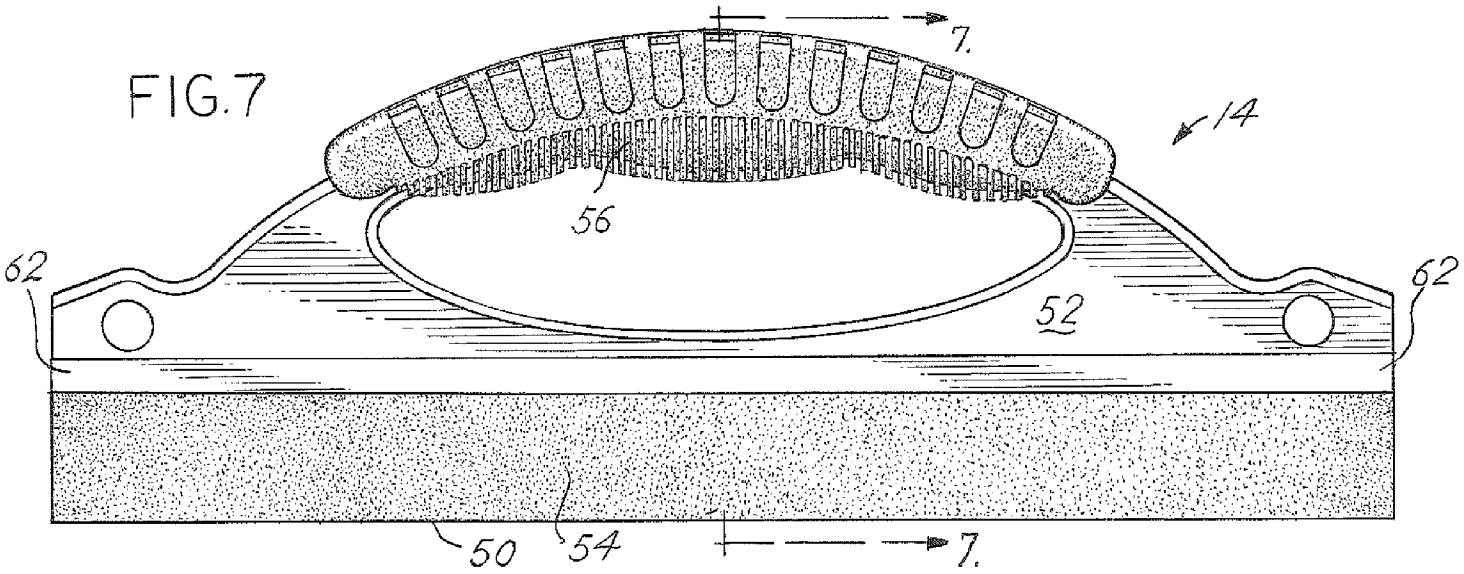
FIG. 7 is a front view of the squeegee.
Figure 9:
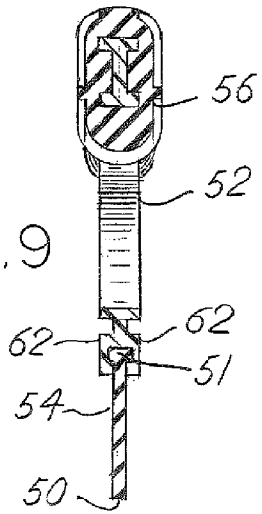
FIG. 9 is a side section view 7-7 of the squeegee.
Figure 8:
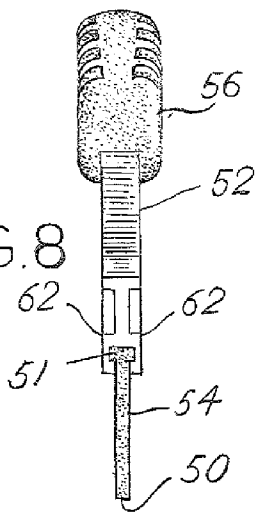
FIG. 8 is a side view of the squeegee.

The spill system 10 includes a tray 12 as shown in FIGS. 1 through 6, squeegee 14 as shown in FIGS. 7 through 9, and a bracket 16 as shown in FIGS. 1 through 3. The squeegee 14 has a handle portion 52 and a wiper 54. The wiper 54 is made from an elongate strip of resilient material with a smooth flat wiping edge 50 along the bottom and a mounting edge 51 opposite the wiping edge 50. The wiping edge 50 is designed to push a liquid or solid along a surface when the squeegee 14 is moved along a surface when the wiping edge 50 is against the surface. The resilient nature of the wiping edge 50 conforms to surface irregularities such that most or the entire spill is pushed with the wiping edge 50. The wiper 54 is affixed to the handle portion 52 by the mounting edge 51. The affixation of the wiper 54 to the handle portion 52 can be accomplished through many means. Tongue-in-groove, insert molding, snap fit, metal forming, crimping, riveting, and similar methods are commonly known in the art. The handle portion 52 is typically made from a stiffer material than the wiper 54. The handle portion 52 has an area 62 adapted to mate with a rearward facing surface 30 as shown in FIG. 6. In the squeegee 14 shown in all FIGS, the area 62 is an entire surface that is part of the handle portion 52. Optionally, the area 62 could be localized near each end. The handle portion 52 has a grip 56 as shown in FIGS. 7 through 9 to enable the user to securely hold the squeegee 14. The grip 56 can have added features or resilient material added for the user's comfort, as is commonly known in the art.

Figure 4:
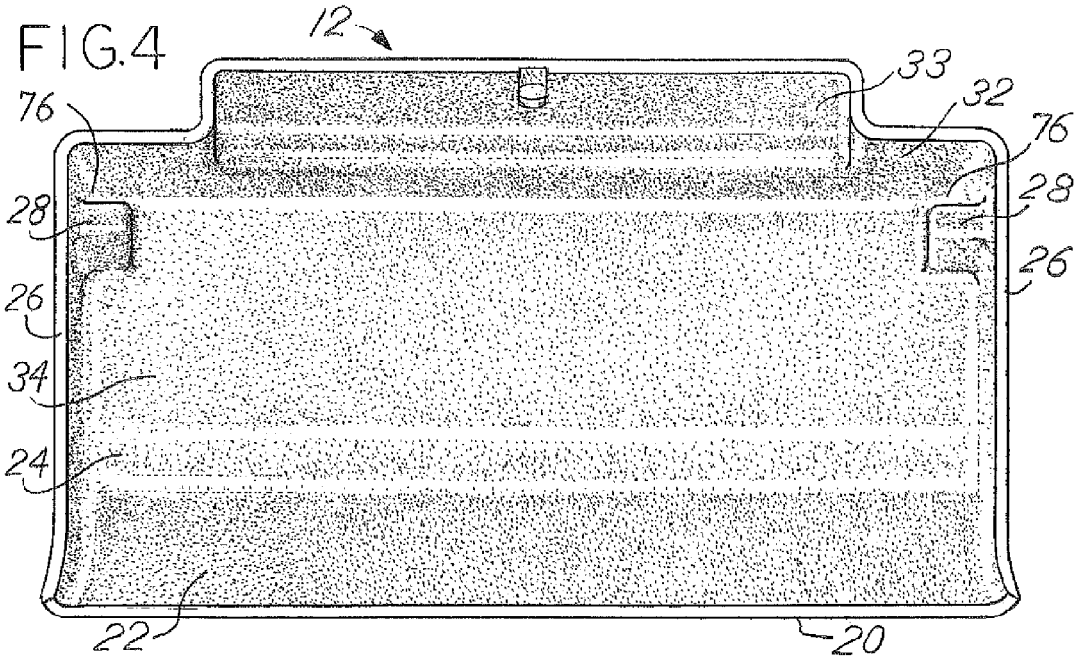
FIG. 4 is a top view of the tray.
Figure 5:
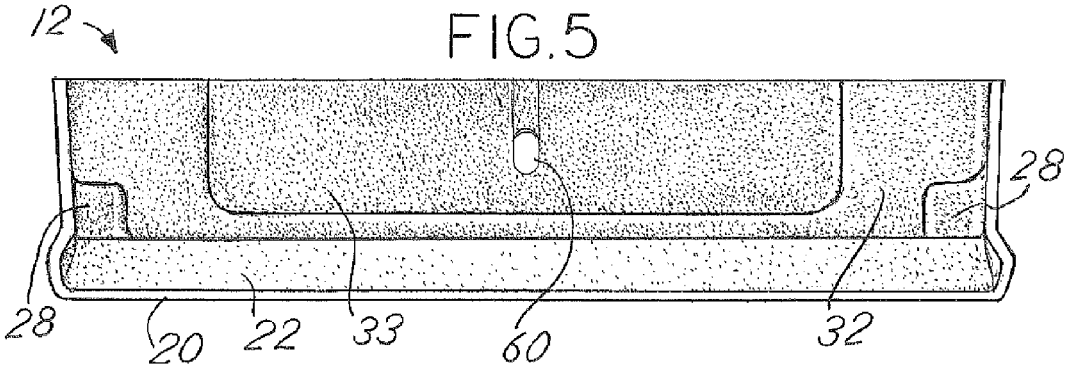
FIG. 5 is a front view of the tray.

The tray 12 has a ramp portion 72, a trough 74, and a squeegee slot 76 as is shown in FIG. 6. As shown in FIGS. 1 through 6, the tray 12 is made from one unitary continuous part, but can be also made from several pieces. The tray 12 can be molded, stamped, deep drawn metal, vacuum formed, or made from any number of methods. The tray 12 as shown in FIGS. 1 through 6 is molded and has a uniform wall thickness throughout most of the tray to reduce warping. The ramp portion 72 is comprised of a front edge 20 which is adjacent to an upwardly sloping surface 22. The front edge 20 is a thin lip or resilient edge. The front edge 20 is formed such that it makes contact with a surface with minimal gaps when placed against it. Preferably, the front edge 20 is sufficiently thin such that when the wiping edge 50 meets the front edge 20, it smoothly transitions from a surface external to the tray (where the spill is located) to the upwardly sloping surface 22. The upwardly sloping surface 22 is continuous with a downwardly sloping surface 24 which forms the front wall of the trough 74. The downwardly sloping surface 24 terminates at the bottom 34, 36. The bottom 34, 36 has an upper bottom surface 34 and a lower bottom surface 36 as shown in FIGS. 2 and 6. The lower bottom surface 36 is substantially coplanar with the front edge 20 as shown in FIG. 6. The angle of the upwardly sloping surface 22 is such that the user can use the squeegee 14 to push a spill up the ramp portion 72 into the trough. The angle of the downwardly sloping surface 24 is such that a spill can be poured or pushed from the trough 74 and disposed. The angles and relationship of the surfaces are shown in FIGS. 3 through 6. The trough 74 is a reservoir designed to hold a spill. The spill could be a liquid, solid, or a combination of the two. The upper bottom surface 34 intersects a series of surfaces that form a continuous perimeter of sufficient height above the upper bottom surface 34. The perimeter keeps a spill contained when the lower bottom surface 36 is substantially horizontal. The perimeter includes the downwardly sloping surface 24, a back wall 32, and lateral sides 26. The back wall 32 is located substantially opposite the downwardly sloping surface 24 as is shown in FIG. 3. The lateral sides 26 adjoin the downwardly sloping surface 24 and the back wall 32 as is shown in FIGS. 1 and 2. Each lateral side 26 has a boss 28 which protrudes inwardly and is spaced from the back wall 32 as shown in FIGS. 2 through 6. The boss 28 for each lateral side 26 has a rearward facing surface 30 substantially parallel to the back wall 32 as shown in FIG. 6. The distance between the rearward facing surface 30 and the back wall 32 is such that it forms a slot 76 intended to receive the squeegee 14 as shown in FIGS. 4 and 6. The boss 28 can also be continuous between lateral sides to form slot 76 across the entire width of the bottom 34, 36. The slot 76 is angled away from the lower bottom surface 36 such that the squeegee 14 rests against the rearward facing surface 30 when the lower bottom surface 36 is substantially vertical as shown in FIG. 2. The upper bottom surface 34 and a lower bottom surface 36 are substantially parallel as shown in FIG. 6. The lower bottom surface 36 can either be one continuous surface or have feet 38 that protrude outward, forming a plane with the front edge 20 as shown in FIG. 6. The back wall 32 can have a protruding back wall 33, where the protruding back wall 33 is connected to and substantially parallel to the back wall 32. The protruding back wall 33 is located further back in order to create space between the tray 12 and the grip 56 so the user can easily access the squeegee 14 as shown in FIG. 2.

A bracket 40 has a first surface 70 that intersects a second surface 44. The first surface 70 is adapted for affixing the bracket 40 to a wall 18, FIGS. 2 and 3. The bracket 40 is affixed to a wall 18 through screws 58, adhesive, clamps, or other attachment method. The wall 18 is considered to be substantially vertical as is shown in FIG. 2. The second surface 44 is adjacent to and intersects the first surface 70. The second surface 44 is angled such that it is at an acute angle from the wall 18 and mates with the sloping surface 22 when the lower bottom surface 36 of the tray is against the wall 18. When the bracket 40 is affixed to the wall 18, the first surface 70 is in sufficient contact with the wall 18 to set the angle of the second surface 44. The first and second surfaces can be a series of contact points or a flat planar surface. Additionally, the bracket 40 can incorporate other features such as a channel to catch any residual spill that may drip from the tray once it is stored.

The spill cleanup system 10 is stored as shown in FIGS. 1 and 2. The rearward facing surface 30 holds the squeegee 14 upward and away from the wall 18 such that it remains in the slot 76 when the system 10 is in the stored position as is shown in FIG. 2. To use the system 10, the user picks up the squeegee 14 and tray 12, typically by grabbing the back wall 32 and possibly the squeegee 14. The front edge 20 is placed near or adjacent to a spill. The front edge 20 is shaped such that it makes sufficient contact with the surface adjacent to a spill. The wiping edge 50 is shaped such that it makes sufficient contact with the surface (such as the floor or a countertop) adjacent to the spill. The user then holds the tray 12 with one hand and uses the squeegee 14 to push the spill towards the front edge 20. The spill is then pushed by the wiper 54 up the upwardly sloping surface 22 and into the trough 74. The user then can transport the spill and dispose of it. The squeegee 14 can also be used to push the spill out of the tray 10. Once the spill is disposed of, the user can replace the squeegee 14 in the slot 76 and then place the two on bracket 40 for storage.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A spill cleanup system comprising:

a squeegee, having a wiping edge;

a tray formed of a single unitary member, having a ramp portion, a trough portion, and a squeegee slot, said ramp portion having a first edge, an upwardly sloping surface extending upwardly from said first edge, said ramp terminating at a downwardly sloping surface continuous with said upwardly sloping surface, said trough portion having lateral sides and a bottom, said bottom having an upper surface and a lower surface, said lateral sides upstanding from said bottom, said downwardly sloping surface defining a front wall of said trough and continuing into said bottom, said trough including a back wall upstanding therefrom located opposite said downwardly sloping surface, said lateral sides connected to said downwardly sloping surface and said back wall and spanning therebetween at a height above said bottom, said bottom substantially coplanar with said first edge, said sides intersecting said bottom, said lateral sides each including a boss extending inwardly into said trough and spaced from said back wall, said bosses having a rearward facing surface spaced from said back wall, said rearward surface and said back wall defining said slot adapted for receiving said squeegee;

a bracket, having a first surface and a second surface, said first surface intersecting said second surface, said first surface adapted for being affixed to a substantially flat surface, said second surface adapted for receiving said ramp portion between said substantially flat surface and said second surface when said first surface and said lower surface of said bottom are substantially coplanar.

2. The spill cleanup system of claim 1, wherein said rearward facing surface of said boss extends upwardly from said bottom, said rearward surface forming an obtuse angle with said lower surface of said bottom.

3. The spill cleanup system of claim 2, wherein said rearward facing surface and said back wall are substantially parallel to form said slot.

4. The spill cleanup system of claim 3, said bottom surface comprising feet protruding outward and coplanar with said first edge.

5. The spill cleanup system of claim 4, said back wall having a protruding back wall substantially parallel to and continuous with said rearward surface and spaced further rearward from said rearward surface.

6. The spill cleanup system of claim 1, said squeegee having a handle portion and a wiper portion, said wiper portion being made from an elongate strip of resilient material, said elongate strip having a wiping edge and a mounting edge, said handle portion being affixed to said mounting edge of said wiper portion.

7. The spill cleanup system of claim 6, said handle portion having a grip adapted for use with a human hand.

8. The spill cleanup system of claim 1, said first edge comprising a resilient material.

9. The spill cleanup system of claim 1, said bottom surface having feet protruding outward and coplanar with said first edge.

10. A spill cleanup system comprising:

a squeegee having a handle portion and a wiper portion, said wiper portion being made from an elongate strip of resilient material, said elongate strip having a wiping edge and a mounting edge, said handle portion being affixed to said mounting edge of said wiper portion;

a tray formed from a single unitary member, having a front edge for receiving a spill, a ramp portion, a trough portion, and a slot, said ramp defined by the surface between said front edge and said trough, said trough defined by a bottom, lateral sides, said ramp portion, and a rear wall opposite said ramp and upstanding from said bottom, forming a containment area adapted for receiving a spill, said slot defined by a boss extending inwardly from said lateral sides and located adjacent to said rear wall, angled rearward and adapted for retaining said squeegee when said rear wall is positioned above said ramp, a rearward facing surface of said boss extends upwardly from said bottom, said rearward surface forming an obtuse angle with a lower surface of said bottom; and a bracket, having a first surface and a second surface, said first surface intersecting said second surface, said first surface adapted for being affixed to a substantially flat surface, said second surface adapted for receiving said ramp portion between said substantially flat surface and said second surface when said first surface and said lower surface of said bottom are substantially coplanar.

11. The spill cleanup system of claim 10, said front edge and ramp forming an opening for receiving a spill, said resilient edge forming a seal to said ramp when said squeegee is in sufficient contact with said ramp.

12. The spill cleanup system of claim 11, wherein said rearward facing surface of said boss and said back wall are substantially parallel to form said slot.

13. The spill cleanup system of claim 12, said front edge and ramp portion being wider than said squeegee.

14. The spill cleanup system of claim 13, said bottom surface comprising feet protruding outward and coplanar with said first edge.

15. A spill cleanup system comprising:

a squeegee having a handle portion and a wiper portion, said wiper portion being made from an elongate strip of resilient material, said elongate strip having a wiping edge and a mounting edge, said handle portion being affixed to said mounting edge of said wiper portion;

a tray formed from a single unitary member of thermoplastic and having a substantially uniform wall thickness, having a front edge for receiving a spill, a ramp portion, a trough portion, and a slot, said ramp defined by the surface between said front edge and said trough, said trough defined by a bottom, lateral sides, and a rear wall opposite said ramp and upstanding from said bottom, forming a containment area adapted for receiving a spill, said slot defined by a boss extending inwardly from said lateral sides and located adjacent to said rear wall, angled rearward and adapted for retaining said squeegee when said rear wall is positioned above said ramp, a rearward facing surface of said boss extends upwardly from said bottom, said rearward facing surface forming an obtuse angle with a lower surface of said bottom, said rearward facing surface and said rear wall are substantially parallel to form said slot; and a bracket, having a first surface and a second surface, said first surface intersecting said second surface, said first surface adapted for being affixed to a substantially flat surface, said second surface adapted for receiving said ramp portion between said substantially flat surface and said second surface when said first surface and said lower surface of said bottom are substantially coplanar.

16. The spill cleanup system of claim 15, said front edge and ramp forming an opening for receiving a spill, said front edge including a resilient edge, said resilient edge forming a seal to said ramp when said squeegee is in sufficient contact with said ramp.

17. The spill cleanup system of claim 16, said front edge and ramp portion wider than said squeegee.

18. The spill cleanup system of claim 17, said bottom surface comprising feet protruding outward and coplanar with said front edge.

19. The spill cleanup system of claim 18, wherein said rearward facing surface of said boss extending upwardly from said bottom.

* * * * *